US005309873A

United States Patent [19]

Suga et al.

[11] Patent Number: 5,309,873

[45] Date of Patent: May 10, 1994

[54] VALVE TIMING CONTROL SYSTEM FOR INTERNAL COMBUSTION ENGINE

[75] Inventors: Seiji Suga; Hiroaki Imai, both of Atsugi, Japan

[73] Assignee: Atsugi Unisia Corporation, Atsugi, Japan

[21] Appl. No.: 982,695

[22] Filed: Nov. 27, 1992

[30] Foreign Application Priority Data

Nov. 28, 1991 [JP] Japan ..... 3-97575[U]

[51] Int. Cl.[5] ..... F01L 1/34

[52] U.S. Cl. ..... 123/90.17; 123/90.31; 464/2

[58] Field of Search ..... 123/90.15, 90.17, 90.31; 464/1, 2, 160; 74/568 R, 567

[56] References Cited

U.S. PATENT DOCUMENTS

| | | | |
|---|---|---|---|
| 4,535,731 | 8/1985 | Banfi | 123/90.15 |
| 4,627,825 | 12/1986 | Bruss et al. | 464/2 |
| 4,858,572 | 8/1989 | Shirai et al. | 123/90.31 |
| 4,889,086 | 12/1989 | Scapecchi et al. | 123/90.31 |
| 4,895,113 | 1/1990 | Speier et al. | 123/90.31 |
| 4,903,650 | 2/1990 | Ohlendorf et al. | 123/90.17 |
| 5,012,773 | 5/1991 | Akasaka et al. | 123/90.17 |
| 5,058,539 | 10/1991 | Saito et al. | 123/90.17 |
| 5,067,450 | 11/1991 | Kano et al. | 123/90.17 |
| 5,088,456 | 2/1992 | Suga | 123/90.17 |
| 5,138,985 | 8/1992 | Szodfridt et al. | 123/90.17 |
| 5,144,921 | 9/1992 | Clos et al. | 123/90.17 |
| 5,189,999 | 3/1993 | Thoma | 123/90.17 |

FOREIGN PATENT DOCUMENTS

| | | | |
|---|---|---|---|
| 0422791A1 | 4/1991 | European Pat. Off. . | |
| 3316162 | 11/1983 | Fed. Rep. of Germany . | |
| 5329624 | 3/1991 | Fed. Rep. of Germany ... | 123/90.17 |
| 91/14082 | 9/1991 | PCT Int'l Appl. . | |
| 2152193A | 7/1985 | United Kingdom . | |
| 2228780A | 9/1990 | United Kingdom . | |
| 2229514A | 9/1990 | United Kingdom . | |

*Primary Examiner*—E. Rollins Cross
*Assistant Examiner*—Weilun Lo
*Attorney, Agent, or Firm*—Foley & Lardner

[57] ABSTRACT

A valve timing control system for an internal combustion engine is provided. This system comprises a sprocket assembly connected to a crankshaft of the engine, a camshaft assembly connected to the sprocket assembly for driving intake and/or exhaust valves of the engine, a ring gear assembly disposed between the sprocket assembly and the camshaft assembly, and a fluid power source for providing fluid pressure to a pressure chamber to axially displace the ring gear assembly to vary a phase angle relation over a range of first to second phase angles. A fluid pressure supply and drain lines are defined in the system which communicates between the fluid power source and the pressure chamber and between the pressure chamber and a drain port of the system respectively. The system further includes a solenoid operated directional control valve which is responsive to a control signal from a controller to selectively block the fluid pressure supply or drain lines according to variation in engine operating conditions for varying the valve timing.

8 Claims, 3 Drawing Sheets

VALVE TIMING CONTROL SYSTEM FOR INTERNAL COMBUSTION ENGINE

BACKGROUND OF THE INVENTION

1. Field of the Invention

The present invention relates generally to an intake and/or exhaust valve timing control system for an internal combustion engine. More particularly, the invention is directed to an intake and/or exhaust valve timing control system which is operable to modify the intake and/or exhaust valve timing quickly, with reduced consumption of working fluid, in response to variation in engine operating conditions.

2. Description of the Prior Art

U.S. Pat. No. 4,535,731 assigned to Alfa Romeo Auto S.p.A. discloses a conventional valve timing control system for an internal combustion engine. In this valve timing control system, a camshaft disposing cams thereon for controlling intake and exhaust valve operations has outer teeth in its end peripheral surface. A timing pulley which is mechanically connected to a crankshaft of the engine through a timing belt has inner teeth in its inside surface. An intermediate cylindrical member or sleeve which includes a hollow portion having inner helical teeth and outer straight teeth is arranged to engage the outer teeth of the camshaft and the inner teeth of the timing pulley. A pressure chamber is defined between the timing pulley and the camshaft to be oriented to the sleeve so that internal pressure thereof acts on a front end surface of the sleeve. The sleeve is always urged toward the pressure chamber by a coil spring. A driving mechanism is provided which includes a hydraulic supply line for directing hydraulic pressure generated by an oil pump to the pressure chamber and a hydraulic drain line for discharging both the hydraulic pressures in the pressure chamber and the hydraulic supply line from a drain port through a relief valve. With this arrangement, a control unit provides a control signal according to engine operating conditions to activate the relief valve to modify a pressure level in the pressure chamber. This modified pressure then acts on the sleeve to be displaced in an axial direction according to a balance between the pressure level of the pressure chamber and a spring force of the coil spring, thereby regulating a phase angle between the timing pulley and the camshaft to advance or retard the valve timing of the intake valves.

However, in the above prior art valve timing control system, a phase angle between the timing pulley and the camshaft is, as mentioned above, changed by the activity of the relief valve arranged in the hydraulic drain line. Therefore, when the relief valve is opened, a large amount of pressurized working fluid supplied from the oil pump is simply discharged to an oil pan of the engine. In other words, a large amount of working fluid (i.e., a lubricating oil stored in the oil pan) circulates between the system and the oil pan. Thus, a supply of lubricating oil for sliding parts of the engine becomes insufficient.

In order to avoid such a drawback, a fixed orifice may be arranged in the hydraulic supply line for restricting an amount of working fluid directed to the pressure chamber. This arrangement, however, also encounters a drawback in that, when it becomes necessary to supply high pressure of working fluid to the pressure chamber, as engine load is increased by acceleration operation by a driver for example, pressure elevation in the pressure chamber is undesirably delayed due to the orifice. Thus, the internal pressure in the pressure chamber required for displacing the sleeve is reduced momentarily, resulting in a response rate for varying the valve timing being delayed.

SUMMARY OF THE INVENTION

It is therefore a principal object of the present invention to avoid the disadvantages of the prior art.

It is another object of the present invention to provide a valve timing control system for an internal combustion engine which is operable to vary valve timing at a quick response rate with reduced working fluid consumption.

According to one aspect of the present invention, there is provided a valve timing control system for an internal combustion engine which comprises a rotary member rotatable according to engine speed, a camshaft assembly rotatably connected to the rotary member for driving intake and/or exhaust valves of the engine, a phase angle adjusting means, disposed between the rotary member and the camshaft assembly, for adjusting a phase angle relation between the rotary member and the camshaft assembly over a range of first to second phase angles, the second phase angle being different from the first phase angle by a preselected degree, a driving means including a fluid power source and a pressure chamber, the fluid power source providing fluid pressure to the pressure chamber to activate the phase angle adjusting means for varying the phase angle relation over the range of the first to second phase angles, a fluid pressure supply line fluidly communicating between the fluid power source and the pressure chamber, a fluid pressure drain line fluidly communicating between the pressure chamber and a drain port, a switching means having first and second switching positions, the first switching position being to establish the fluid communication between the pressure chamber and the drain port through the fluid pressure drain line so that the phase angle adjusting means modifies the phase angle relation toward the first phase angle, the second switching position being to establish the fluid communication between the pressure chamber and the fluid power source so that the phase angle adjusting means modifies the phase angle relation toward the second phase angle, and a control unit is responsive to variation in engine operating conditions to provide a control signal to the switching means to be switched between the first and second switching positions.

In the preferred mode, the fluid pressure supply line may include a first fluid passage connected to the pressure chamber and a second fluid passage connected to the fluid power source. The fluid pressure drain line may be provided with the first fluid passage of the fluid pressure supply line and a third fluid passage connected to the drain port. The switching means may include a valve spool which is displaced between first and second valve positions, the first valve position accomplishing fluid communication between the first and third fluid passages while blocking fluid communication between the first and second fluid passages, the second valve position establishing the fluid communication between the first and second fluid passages while blocking the fluid communication between the first and third fluid passages.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiments but are for explanation and understanding only.

In the drawings.

DESCRIPTION OF THE PREFERRED EMBODIMENT

Figure 1:
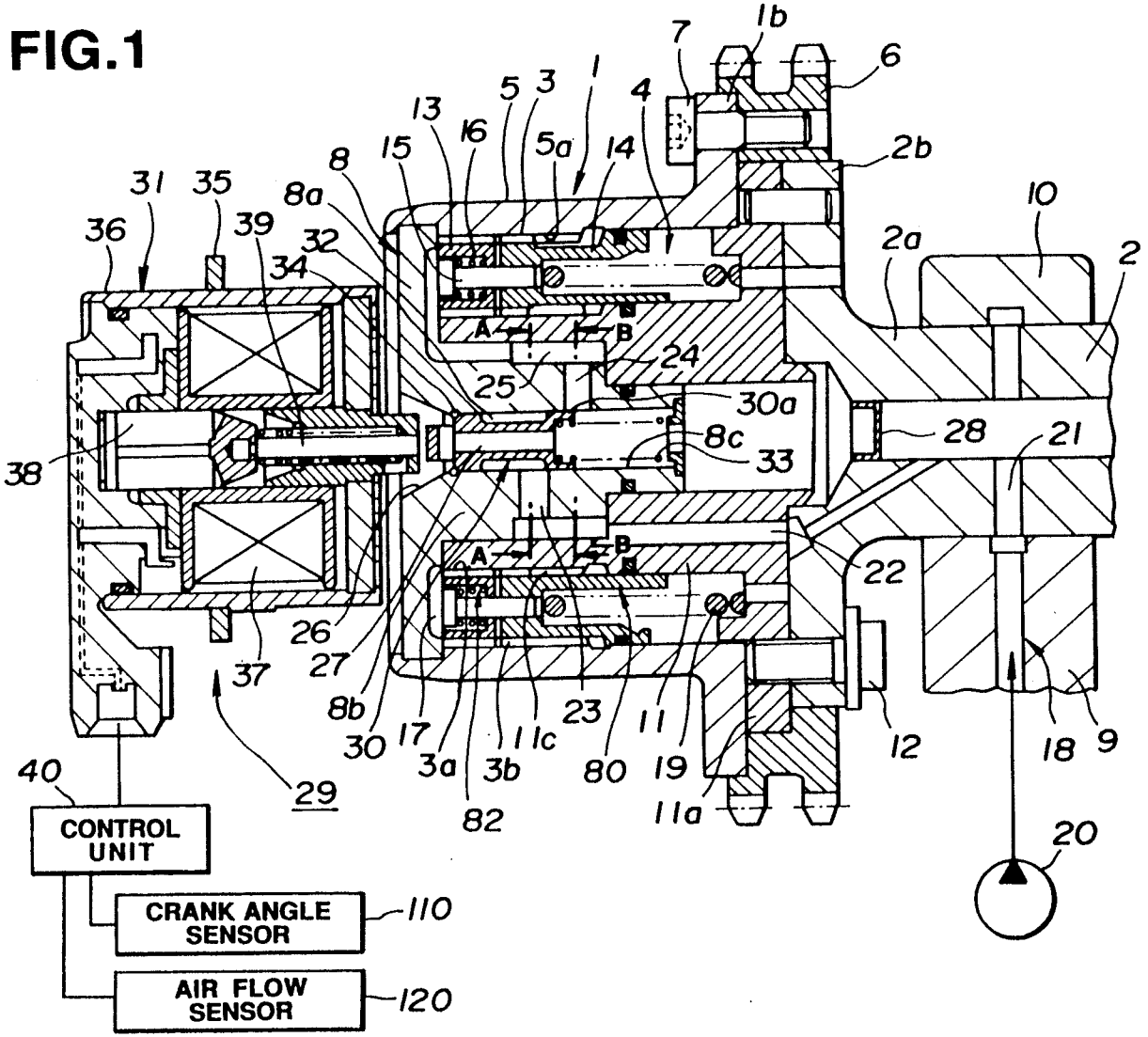
FIG. 1 is a longitudinal sectional view which shows a valve timing control system according to the present invention.
Figure 2:
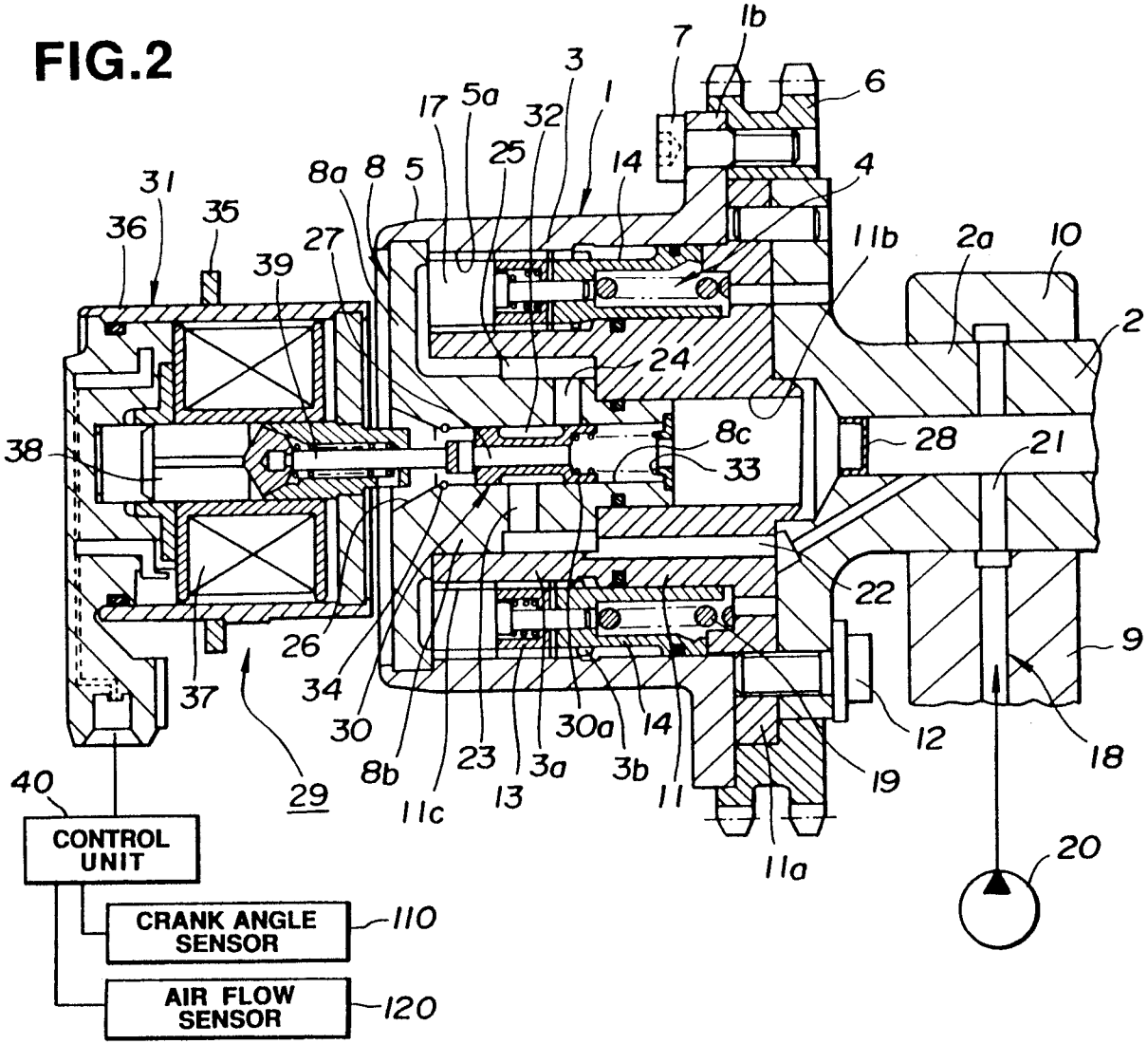
FIG. 2 is an explanatory view which shows the system operation when an engine load is increased to a high level.

Referring now to the drawings, particularly to FIGS. 1 and 2, there is shown a valve timing control system according to the present invention which is suitable for controlling valve timing of intake valves of a double over-head camshaft (DOHC) type of internal combustion engine. However, the similar construction with minor modification if required, is applicable even for a single over-head camshaft type of internal combustion engine.

The valve timing control system includes generally a driven sprocket assembly 1, a camshaft 2 disposing cams, a ring gear assembly 3, and a driving mechanism 4. The sprocket assembly 1 is mechanically connected to an engine crankshaft through a timing chain (neither shown). Rotation of the crankshaft causes the sprocket assembly 1 to rotate, thereby operating the camshaft in synchronism with the crankshaft to open and close intake valves in preselected timing. The ring gear assembly 3 is disposed between the sprocket assembly 1 and the camshaft 2 in engagement therewith and functions as a piston which is laterally or axially displaced by the driving mechanism 4 to modify a phase angle between the sprocket assembly 1 and the camshaft 2.

The sprocket assembly 1 includes a cylindrical base section 5 and a toothed section 6. The toothed section 6 is secured to a flange 1*b* of the base section 5 by bolts 7. The cylindrical base section 5 includes a front cover member 8 and inner gear teeth 5*a* formed in its inside wall. The front cover member 8 has an essentially T-shaped cross-section which includes a disc section 8*a* fitted into an end portion of the cylindrical base section 5 by caulking to enclose a front aperture of the base section 5 and a cylindrical section 8*b* extending from the central portion of the disc section 8*a* coaxially with the camshaft 2.

The camshaft 2 is journaled at its end portion 2*a* by a cam bearing 10 provided on an upper portion of a cylinder head 9. Attached to a flange 2*b* of the end portion 2*a* in alignment therewith by means of bolts 12 is a sleeve 11. The sleeve 11 includes a flange 11*a* in engagement with the flange 2*b* of the camshaft 2 and a stepped through hole 11*b* as shown in FIG. 2, into which the cylindrical section 8*b* of the front cover member 8 is inserted into engagement therewith. Formed in a peripheral surface of the front end portion of the sleeve 11 are outer gear teeth 11*c*.

The ring gear assembly 3 includes first and second ring gear elements 13 and 14 which are separated from each other and which have inner and outer helical gear teeth 3*a* and 3*b* on their inner and outer surfaces meshing with the outer gear teeth 11*c* of the sprocket assembly 1 and the inner gear teeth 5*a* of the sleeve 11, respectively, in a spiral fashion. The first and second ring gear elements 13 and 14 are formed in such a manner as to cut a single ring gear member transversely into two parts which have annular grooves 80 and 82 each defining an essentially U-shaped longitudinal cross-section. A plurality of holes are then formed in the bottoms of the first and second ring gear elements 13 and 14 respectively in coincidence with each other so that tooth traces of the first and second gear elements are offset by a degree required for compensating backlashes between the outer helical gear teeth 3*b* and the inner gear teeth 5*a* of the sprocket assembly 1 and between the inner helical gear teeth 3*a* and the outer gear teeth 11*c* of the sleeve 11, thereby preventing noise caused by impact created between the gears due to variation in torque of the camshaft 2 from occurring. Connecting pins 15 are press-fitted into the holes of the second gear element 14. Coil springs 16 are arranged between heads of the connecting pins 15 and the bottom of the first ring gear element 13 respectively so that the first ring gear element 13 is urged into constant engagement with the second ring gear element 14.

The driving mechanism 4 includes an annular pressure chamber 17, a hydraulic circuit 18, a compression coil spring 19, and a hydraulic power source or oil pump 20. The pressure chamber 17 is defined between the disc section 8*a* of the front cover member 8 and the first ring gear element 13. The hydraulic circuit 18 includes a hydraulic supply line which fluidly communicates between the pressure chamber 17 and the oil pump 20 and a hydraulic drain line which drains hydraulic pressure only in the pressure chamber 17 outside the system. The compression coil spring 19 is arranged between the annular groove 80 of the second ring gear element 14 and the inner wall of the flange 11*a* of the sleeve 11 to bias the ring gear assembly 3 in a left direction as viewed in the drawings.

Figure 3:
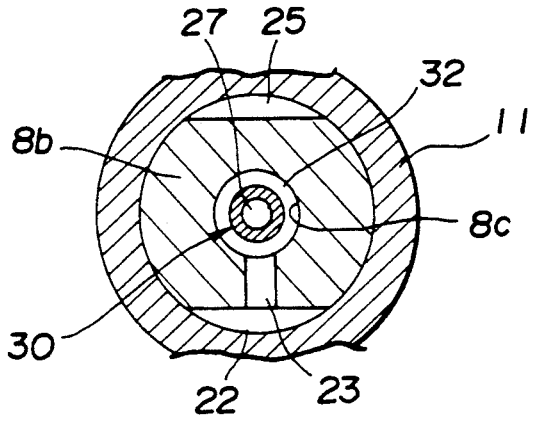
FIG. 3 is a cross-sectional view taken along the line A—A in FIG. 1 which shows hydraulic supply and drain lines.
Figure 4:
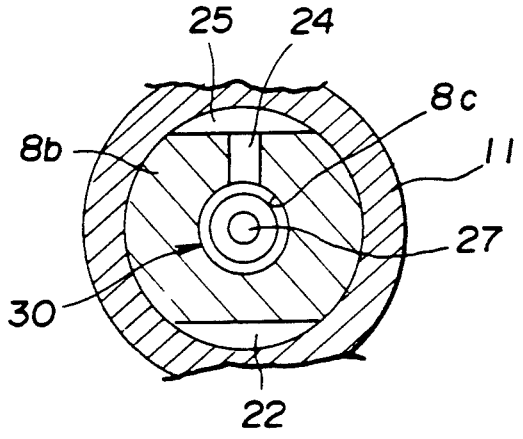
FIG. 4 is a cross-sectional view taken along the line B—B in FIG. 1 which shows hydraulic supply and drain lines.

The hydraulic supply line includes first, second, third, fourth, and fifth hydraulic passages 21, 22, 23, 24, and 25. The first hydraulic passage 21 is connected to the oil pump 20 through a main oil gallery (not shown) and includes radially and axially extending sections. The radially extending section is defined in the cylinder head 9, the cam bearing 10, and the camshaft 2. The axially extending section is defined in the camshaft 2 along the center line thereof. The left end of the axially extending section is sealed with a plug 28 in the illustrated manner. The second hydraulic passage 22 extends obliquely through the end portion 2*a* and the flange 2*b* of the camshaft 2 and then axially through the sleeve 11 into a space, as shown in FIG. 3, defined between an outer surface of the cylindrical section 8*b* of the front cover member 8 and an inner surface of the through hole 11*b* in the sleeve 11. The third hydraulic passage 23, as shown in FIG. 3, extends radially through the cylindrical section 8*b* to communicate with a valve bore 8*c* extending through the cylindrical section 8*b* along the center line thereof. Likewise, the fourth hydraulic passage 24, as shown in FIG. 4, extends radially through the cylindrical section 8*b* so that it communicates with the valve bore 8c out of alignment with the third hydraulic passage 23. The fifth hydraulic passage 25 is provided with a space defined, between the outer surface of the cylindrical section 8b and the inner surface of the through hole 11b of the sleeve 11, opposite the second hydraulic passage 22 with respect to the cylindrical section 8b to establish fluid communication between the pressure chamber 17 and the fourth hydraulic passage 24.

The hydraulic drain line is provided with the fourth and fifth hydraulic passages 24 and 25 of the hydraulic supply line and a sixth hydraulic passage 27. The sixth hydraulic passage 27 includes first and second sections extending axially and radially through a valve spool 30 (as will be described hereinafter in detail) to communicate between the valve bore 8c and a conical draining port 26 which is formed in the central portion of the disc section 8a.

The valve timing control system further includes a directional control valve means 29 arranged on the front cover member 8 with a given clearance therebetween which serves to switch hydraulic fluid flow between the hydraulic supply and drain lines according to engine operating conditions. The directional control valve means 29 includes the valve spool 30, as already mentioned, which is slidably disposed in the valve bore 8c and a solenoid operated actuator 31 which is operable to displace the valve spool 30 to the right, as viewed in the drawings.

The valve spool 30 includes an annular groove 32 in its outer surface and a hollow cylindrical valve portion 30a. A coil spring 33 is arranged in the valve bore 8c to urge the valve spool 30 into constant engagement with a stopper ring 34 which is installed on an end inner wall of the valve bore 8c. The valve spool 30 is displaceable between first and second valve positions. The first valve position is, as shown in FIG. 1, such that the valve spool 30 is urged by spring force of the coil spring 33 into contact with the stopper ring 34 to block the fluid communication between the third and fourth hydraulic passages 23 and 24 and establish the fluid communication between the fourth and sixth hydraulic passages 24 and 26. The second valve position is, as shown in FIG. 2, such that the valve spool 30 is shifted by the solenoid operated actuator 31 toward its rightmost position to establish the fluid communication between the third and fourth hydraulic passages 23 and 24 through the annular groove 32 and block the fluid communication between the fourth and sixth hydraulic passages 24 and 26.

The solenoid operated actuator 31 includes a cylindrical housing 36, a solenoid 37 accommodated within the housing, a core 38, and an operation plunger 39. The cylindrical housing 36 is secured to a chain cover (not shown) through a retainer 35. The operation plunger 39 is attached to a top end of the core 38 and projects from the housing 36 in alignment with the valve spool 30. With this arrangement, the solenoid operated actuator 31 is responsive to an ON-OFF control signal from a control unit 40 to move the operation plunger 39 back and forth to displace the valve spool 30. The control unit 40 is provided with a microcomputer which is operable to monitor engine operating conditions based on sensor signals indicative of engine speed and/or intake air flow detected by a crank angle sensor 110 and an airflow sensor 120 respectively.

In operation, when engine speed, or engine load is lower than a preselected threshold level, the control unit 40 is responsive to the sensor signals from the crank angle sensor 110 and the airflow sensor 120 to provide an OFF signal to the solenoid operated actuator 31 so that the valve spool 30 is, as shown in FIG. 1, urged by the coil spring 33 toward the leftmost position, or the first valve position to establish the fluid communication between the fourth hydraulic passage 24 and the valve bore 8c with the fluid communication between the fourth hydraulic passage 24 and the annular groove 32 being blocked. Thus, hydraulic pressure provided by the oil pump 20 is held in the first, second and third hydraulic passages 21, 22, and 23 and the annular groove 32, while hydraulic pressure in the pressure chamber 17 is discharged outside the system from the sixth hydraulic passage 26 through the fifth and fourth hydraulic passages 25 and 24 and the valve bore 8c, reducing a pressure level in the pressure chamber 17 quickly. With this reduced pressure level, the ring gear assembly 3 is displaced to the left and then retained at the leftmost position by the spring force of the compression coil spring 19 with the result that a phase angle between the sprocket assembly 1 and the camshaft 2 is changed so that intake valve close timing is retarded most.

When the engine load is increased, by, for example, accelerating operation by a driver, higher than the preselected threshold level, the control unit 40 provides an ON-signal to the solenoid operated actuator 31 so that the solenoid 37 is energized to thrust the operation plunger 39 via the core 38 toward the right, pushing the valve spool 30 against the spring force of the compression coil spring 33. Upon reaching the rightmost position or the second valve position, the valve spool 30, as shown in FIG. 2, blocks the fluid communication between the fourth hydraulic passage 24 and the valve bore 8c (i.e., the sixth hydraulic passage 27) by the valve portion 30a and establishes the fluid communication between the third and fourth hydraulic passages 23 and 24 through the annular groove 32. As a result, the hydraulic pressure from the oil pump 20 is supplied to the pressure chamber 17 through the first, second, and third hydraulic passages 21, 22, and 23, the annular groove 32, and the fourth and fifth hydraulic passage 24 and 25. Especially, the hydraulic pressure of a high level held in the annular groove 32, the third, second, and first hydraulic passages 23, 22, and 21 when the solenoid operated actuator 31 is deactivated is transmitted directly to the pressure chamber 17, thereby elevating a pressure level therein rapidly. With this elevated pressure in the pressure chamber 17, the ring gear assembly 3 is displaced toward the rightmost position against the spring force of the coil spring 19 so that the phase angle between the sprocket assembly 1 and the camshaft 2 is shifted for advancing the intake valve close timing.

Accordingly, it will be appreciated that the above arrangement of the valve timing control system is operable to discharge hydraulic pressure in the pressure chamber 17 quickly and supplied hydraulic pressure to the pressure chamber 17 without provision of an orifice in the hydraulic supply line. Thus, the operating response of the ring gear assembly 3 is enhanced so that phase angle changing operation between the sprocket assembly 1 and the camshaft 2 is carried out rapidly, resulting in the valve timing control response being greatly improved. Additionally, when engine load falls in a lower level range, hydraulic pressure only in the pressure chamber is drained while holding hydraulic pressure of a high level provided by the oil pump 20 in the hydraulic pressure supply line. Therefore, the valve timing control system of the invention may be operated with greatly reduced pressure consumption.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A valve timing control system for an internal combustion engine, comprising:

a rotary member rotatable according to engine speed;

a camshaft assembly rotatably connected to said rotary member for driving at least one of an intake and an exhaust valve of the engine;

phase angle adjusting means, disposed between said rotary member and said camshaft assembly, for adjusting a phase angle relation between said rotary member and said camshaft assembly over a range of first to second phase angles, the second phase angle being different from the first phase angle by a preselected degree;

driving means including a fluid power source and a pressure chamber, the fluid power source providing fluid pressure to the pressure chamber to activate said phase angle adjusting means for varying the phase angle relation over the range of the first to second phase angles;

said phase angle adjusting means including a ring gear assembly having helical gear teeth on outer and inner surfaces thereof which mesh with gear teeth formed on said rotary member and said camshaft assembly, respectively, the ring gear assembly being responsive to elevation in the fluid pressure in the pressure chamber so as to be displaced in an axial direction of the camshaft assembly, thereby varying the phase angle relation over the range of first to second phase angles;

a fluid pressure supply line fluidly communicating between the fluid power source and the pressure chamber;

a fluid pressure drain line fluidly communicating between the pressure chamber and a drain port;

switching means having first and second switching positions, the first switching position establishing the fluid communication between the pressure chamber and the drain port through said fluid pressure drain line so that said phase angle adjusting means varies the phase angle relation toward the first phase angle, the second switching position establishing the fluid communication between the pressure chamber and the fluid power source so that said phase angle adjusting means varies the phase angle relation toward the second phase angle; and a control unit responsive to variation in engine operating conditions to provide a control signal to said switching means to be switched between the first and second switching positions;

wherein said camshaft assembly includes a sleeve having gear teeth meshing with the gear teeth formed on the inner surface of said ring gear assembly, said rotary member includes a member rotatably inserted into the sleeve, said rotatably inserted member forming a valve bore, said fluid pressure supply line includes a first fluid passage communicating the pressure chamber with the valve bore and a second fluid passage communicating the valve bore with the fluid power source, said fluid pressure drain line includes said first fluid passage and a third fluid passage communicating the valve bore with the drain port, and said switching means includes a valve spool disposed in the valve bore for displacement between first and second valve positions, the first valve position establishing fluid communication between the first and third fluid passages, while blocking fluid communication between the first and second fluid passages, the second valve position establishing fluid communication between the first and second fluid passages, while blocking fluid communication between the first and third fluid passages, said switching means further including an actuator for displacing the valve spool between the first and second valve positions.

2. A valve timing control system as set forth in claim 1, wherein said valve spool includes an annular groove in a peripheral surface thereof and a through hole, the annular groove serving to block the fluid communication between the second and the first fluid passage at the first valve position for holding the fluid pressure supplied from the fluid power source in the second fluid passage and establish the fluid communication between the first and second fluid passages at the second valve position, the through hole connected to the drain port for defining at least part of the third fluid passage.

3. A valve timing control system as set forth in claim 1, wherein said actuator includes a solenoid and an operation plunger, the operation plunger being arranged in alignment with the valve spool, the solenoid being responsive to the control signal from said control unit to thrust the operation plunger for displacing the valve spool between the first and second valve positions.

4. A valve timing control system for an internal combustion engine, comprising;

a fluid power source;

a rotary member;

a camshaft joined with said rotary member;

phase angle adjusting means for effecting adjustment of a phase angle relationship of said rotary member relative to said camshaft, said phase angle adjusting means including a pressure chamber;

said rotary member including a bore and a first hydraulic fluid passage having a first end opening to said bore and an oppositely disposed second end opening to said pressure chamber, said rotary member also including a second hydraulic fluid passage having a first end opening to said bore and an oppositely disposed second end always connected to said fluid power source; and a valve including a valve element disposed in said bore, said valve element having a first position in which there is established a fluid flow communication between said first ends of said first and second hydraulic fluid passages and a second position in which said valve element covers said first end of said second hydraulic fluid passage to block said fluid flow communication.

5. A valve timing control system as claimed in claim 4, wherein said valve element is in the form of a spool formed with a groove which is in fluid communication with said one end of said second hydraulic fluid passage not only when said valve element is in said first position, but also when said valve element is in said second position.

6. A valve timing control system as claimed in claim 5, wherein said groove of said spool is allowed to communicate with said one end of said first hydraulic fluid passage when said valve element is in said first position, while said groove of said spool is prevented from communicating with said one end of said first hydraulic fluid passage when said valve element is in said second position.

7. A valve timing control system as claimed in claim 6, wherein said spool defines a third hydraulic fluid passage having one end always in fluid communication with said bore and an opposite end drained.

8. A valve timing control system as claimed in claim 7, wherein, when said valve element is in said first position, said spool covers said one end of said first hydraulic fluid passage to prevent said one end of said first hydraulic fluid passage from communicating with said bore, while when said valve element is in said second position said spool uncovers said one end of said first hydraulic fluid passage to allow said one end of said first hydraulic fluid passage to communicate with said bore.

* * * * *